US006240855B1

(12) United States Patent
Pirkl et al.

(10) Patent No.: US 6,240,855 B1
(45) Date of Patent: Jun. 5, 2001

(54) CONVERTIBLE PORTABLE TABLE ASSEMBLY

(75) Inventors: Paul M. Pirkl, Burnsville; Robert W. Stimson, Bloomington, both of MN (US)

(73) Assignee: Table Guys, Inc., Bloomington, MN (US)

( * ) Notice: Subject to any disclaimer, the term of this patent is extended or adjusted under 35 U.S.C. 154(b) by 0 days.

(21) Appl. No.: 09/303,373

(22) Filed: Apr. 30, 1999

(51) Int. Cl.[7] ..... A47B 3/00
(52) U.S. Cl. ..... 108/115; 108/23
(58) Field of Search ..... 108/23, 115, 16, 108/18; 312/223.5, 258

(56) References Cited

U.S. PATENT DOCUMENTS

| | | | | |
|---|---|---|---|---|
| D. 346,867 | | 5/1994 | Montilla . | |
| D. 351,299 | | 10/1994 | Barrish . | |
| D. 362,097 | | 9/1995 | Brown . | |
| D. 395,368 | | 6/1998 | Adenau et al. . | |
| 2,496,221 | * | 1/1950 | Koch | 312/223.5 X |
| 2,556,870 | * | 6/1951 | Clark | 108/23 |
| 2,764,462 | * | 9/1956 | McDonald | 312/258 X |
| 2,988,082 | * | 6/1961 | Kuhn | 312/258 X |
| 3,009,752 | * | 11/1961 | Mafgulis | 312/258 X |
| 3,013,852 | * | 12/1961 | Rockola | 312/223.5 |
| 3,156,510 | * | 11/1964 | Hindin et al. | 108/23 X |
| 3,319,801 | * | 5/1967 | Nordstrom | 108/18 X |
| 3,436,092 | * | 4/1969 | Werner | 108/115 X |
| 3,612,848 | * | 10/1971 | Kock | 312/223.5 X |
| 3,954,068 | | 5/1976 | Roberts et al. . | |
| 5,373,428 | | 12/1994 | Day . | |
| 5,533,241 | * | 7/1996 | McConnell | 312/223.5 X |
| 5,542,554 | * | 8/1996 | Resnick | 312/223.5 X |
| 5,622,119 | * | 4/1997 | Hsieh | 108/115 |
| 5,640,912 | * | 6/1997 | Diffrient | 108/23 X |
| 5,816,405 | | 10/1998 | Carriger, Jr. . | |
| 5,882,098 | * | 3/1999 | Brown et al. | 312/258 |
| 5,927,214 | * | 7/1999 | Schwartz et al. | 108/115 X |

OTHER PUBLICATIONS

Website www.cheeznpackers.com/newpage.htm for SNAPPEX Versa–lock Locking Extrusion.
Pamphlet describing Master Series Demo Tables (Master Series 4500) and pamphlet with specifications.
Pamphlet for Hubert Fixtures by Design and Demo Stations.

* cited by examiner

*Primary Examiner*—Jose V. Chen
(74) *Attorney, Agent, or Firm*—Malcolm D. Reid; Peter R. Forrest

(57) ABSTRACT

A portable table assembly constructed of plastic and aluminum that may have a built-in shelving system, a lightbox for displaying backlit graphics, and lockable wheels for transport of the closed table and for movement of the open table. The table has no separate parts to assemble and provides for easy mounting of graphics to the front of the assembly. The table has a hinged top, hinged doors, and may have hinged shelves. It sets up in less than fifteen seconds and collapses into a profile less than ten inches wide. It is lightweight and can be shipped by overnight carriers. The portable table assembly can be used to create a smaller lightweight table-top display, and a stand-alone light box for displaying backlit graphics.

18 Claims, 20 Drawing Sheets

12
54 (59)
18
54
54 (59)
34
14
10

12

10
12
16
54 (59)
54
54 (59)
20
22
18

CONVERTIBLE PORTABLE TABLE ASSEMBLY

FIELD OF THE INVENTION

This invention relates to a portable table or booth assembly that is repeatedly convertible between a compact closed storable collapsed configuration and a setup open configuration. More particularly, this invention relates to a table or booth assembly that includes a backlit display panel. In the storable configuration, the table or booth assembly occupies a relatively small space and is easily movable to a desired location. In the open configuration, the table or booth assembly provides a tabletop surface with a storage area and supporting display panels.

This invention also relates to a lightbox, which uses the front panel of the table assembly of this invention. This lightbox provides backlighted graphic display, which, as an independent assembly, may be wall mounted. In addition, this invention also provides a unique corner member which connects and positions structural elements of the table assembly and of the lightbox to assume the unique shape. The corner member also connects and positions elements of the table assembly to allow movement through the various arrangements from the open to the closed configurations.

BACKGROUND OF THE INVENTION

Companies and organizations rely on several ways to present their products, services or information to a potential market or customer. One of the most effective means is to demonstrate the product or service features or present the information via personal interaction directly with the potential customer or user. Some of the techniques include food sampling and promotional hand-out stations in supermarkets, often referred to as "product sampling". Such marketing campaigns generally last for one to several days. A portable table is typically set up in an aisle for product display and sampling, and then taken down for storage until the next use or for transport to another location. Normally, such tables do not provide for effective display of a graphic identifying the product or service being offered, nor do they usually provide a convenient storage area.

Portable tables or booths are used in a number of other situations, including registration tables at special events, serving tables at banquets, product information stands at trade shows and temporary podiums at meetings. These events may last from a few hours to a couple of weeks. Such situations require a temporary, portable table or booth. Generally, presenters may be unskilled at setting up tables or booths requiring complicated assembly and manipulation of separate parts with special tools. Skilled personnel may then be needed for set-up of the exhibit. The time and cost of the presentation is thereby undesirably increased.

The tables most commonly used may be folding card tables with cloth skirts, tables with wood or laminate surfaces, and portable tables or booths assembled from individual parts. Presentations using a typical folding card table suffer from having a top surface inconveniently low for walk-up clientele, and also lack discreet yet accessible storage space. Non-folding tables are heavy, bulky, take up valuable storage space, and are costly and time-consuming to transport. To the knowledge of these inventors, no portable display booth or table currently available offers integral backlit display of graphics.

Backlighted graphic displays are usable in a wide variety of situations calling for an eye-catching display of graphics, advertising or text.

BRIEF DESCRIPTION OF THE INVENTION

The present invention is a convertible, portable table or booth, which is a single, one-piece assembly. The present table or booth is constructable of lightweight, low-cost, durable, attractive materials, such as wood, metal (e.g., steel, aluminum), plastics, composites and combinations thereof. In its open configuration, the assembly of this invention may be variously described as a table, a booth, a cart, or similar descriptors. It is a table, because it provides a convenient horizontal tabletop surface. It is a cart, because it may be designed to be easily rollable with needed display materials positioned thereon. It is a booth, because vertical front and side panels form an enclosure with rear access, within which are supporting shelves. For convenience in this discussion, the present invention will be referred to as a "table assembly," without any intention to place limits on the potential uses thereof. The vertical panels, such as the front panel, may also display graphics with attractive, eye-catching back-lighting. The shelving is discreetly concealed from the customer's view, yet conveniently accessible to the presenter. A rolling mechanism allows easy transport in the closed configuration. Maneuverability in the open configuration is provided by gliders or wheels, which may be lockable for stability when the booth or table has been suitably positioned for use.

The table assembly of this invention is repeatedly convertible between a small compact configuration for storage, shipping and transport, and an open usable configuration for point-of-sale display and presentation. An embodiment of the present invention is sized and adapted to be readily transportable in the trunk or backseat of a typical car, van or similar vehicle.

BRIEF DESCRIPTION OF THE DRAWINGS

The accompanying drawings incorporated in and forming a part of the specification illustrate several aspects of the present invention, and, together with the description, serve to explain the principles of the invention. Throughout this specification, the terms "left" and "right" refer to portions of the table assembly as viewed from the rear, open portion of the assembly when in the set-up configuration. The term "front" refers to the table assembly as viewed by a potential customer from the front display panel. The term "rear" refers to the table assembly as viewed by a presenter from the set-up shelves.

DETAILED DESCRIPTION OF THE INVENTION

Figure 1:
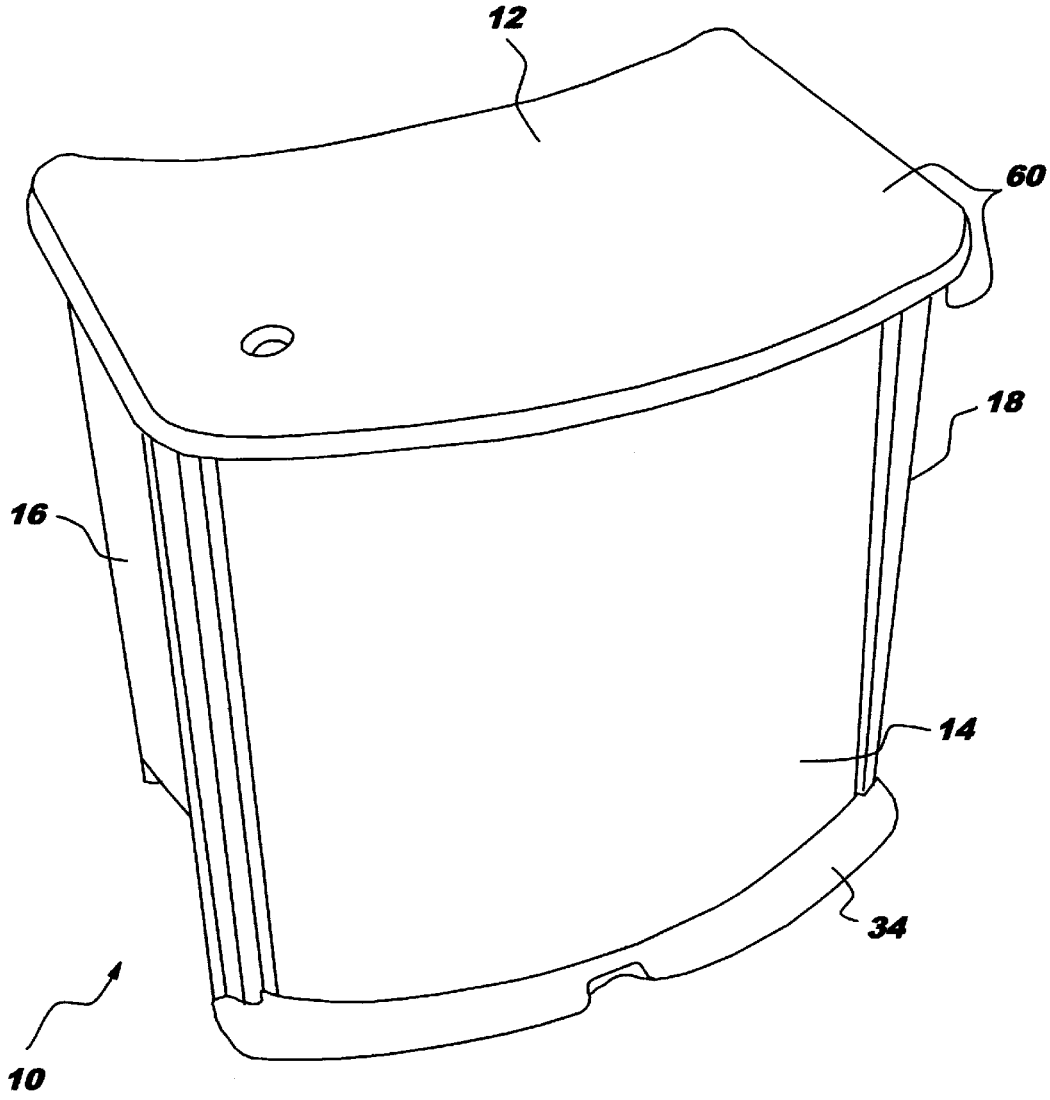
FIG. 1 a perspective view of the right side and front of the table assembly of this invention in the open, set-up configuration.

Referring now to the drawings, FIG. 1 is a perspective view of the front and the right door 16 of the portable convertible table assembly 10, viewed from the front, set-up to provide a tabletop 12 working surface for food sampling, leads collection, distribution of sales literature, registration of guests, or as a surface to display a product. The front panel 14 and side doors 16, 18 serve as vertical surfaces for display of marketing or informational messages or for display of brochures (not shown). The front panel 14 or the side doors 16, 18 or any number of them, may be backlit to provide a more attractive, eye-catching display.

Figure 2:
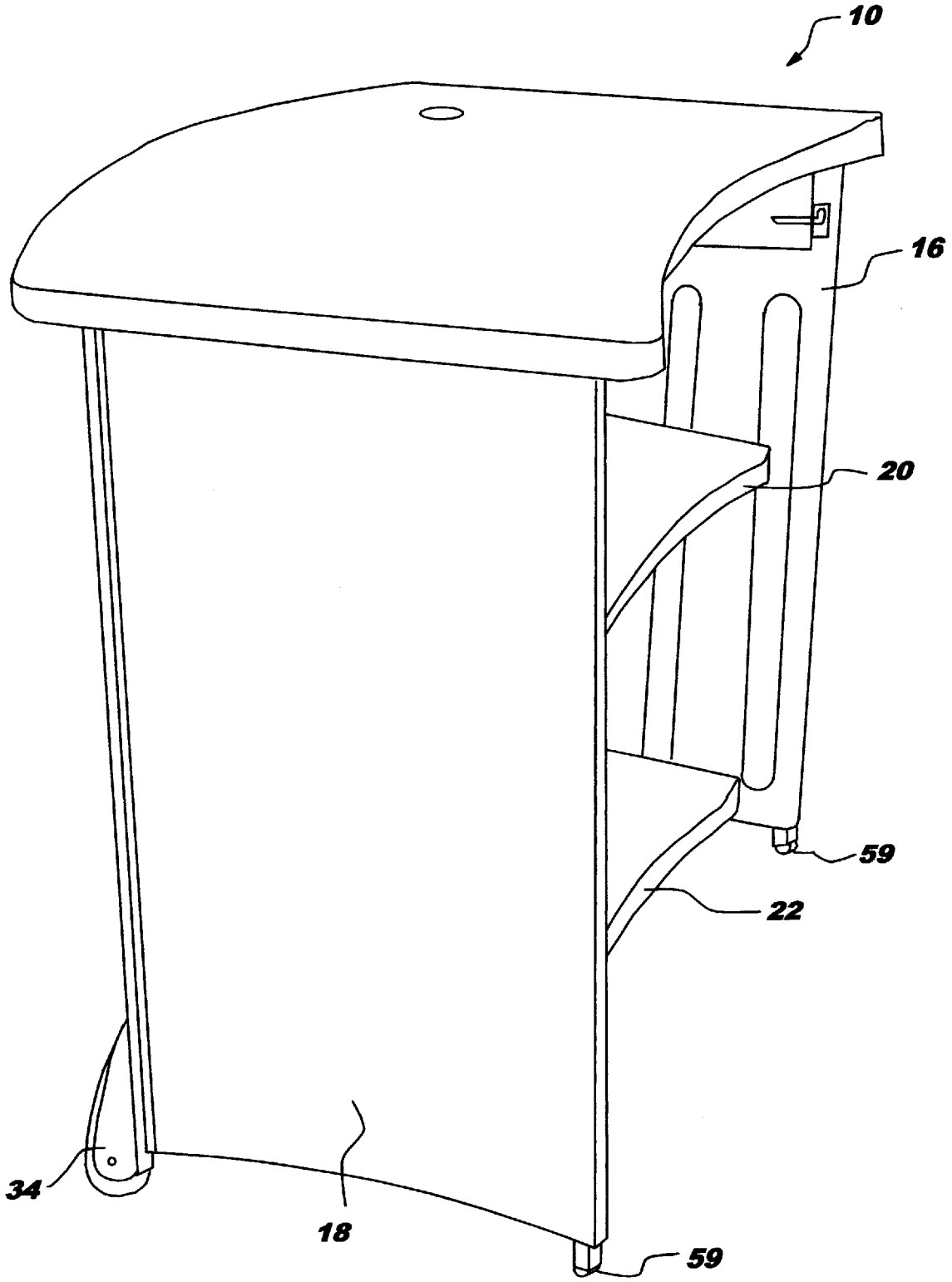
FIG. 2 is a perspective view of the left side and rear of the table assembly of this invention in the open, set-up configuration.

FIG. 2 is a perspective view of the rear and left door 18 of the portable convertible table assembly 10, of FIG. 1 viewed from the rear. The shelves 20, 22 add structural rigidity to the table assembly 10, while also providing discrete, convenient storage of accessories needed during use. As also seen in FIG. 2, attached to a bottom corner of each door 16, 18 and to the base 34 is a protruding slider-based foot 59 that supports the door 16, 18 upright in the open configuration.

Figures 3A, 3B, 3C:
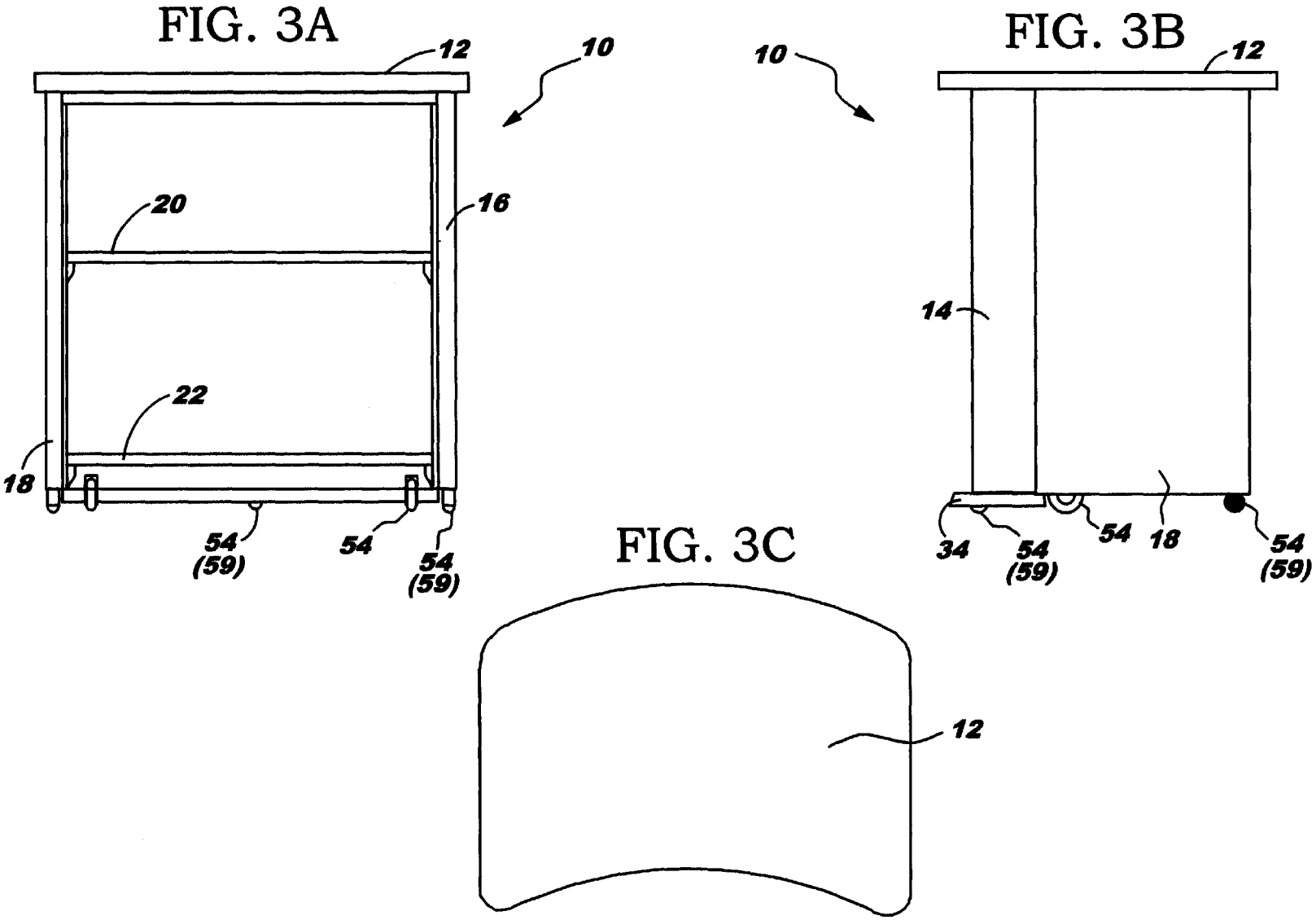
FIG. 3A is a rear view.
FIG. 3B is a left end view.
FIG. 3C is a top view of the table assembly of this invention in the open configuration.

FIGS. 3A and 3B show the back and left side, respectively, of the inventive assembly 10 in the open configuration. The doors 16, 18 support the tabletop 12 and the shelves 20, 22. The central frame member 24 supports the tabletop 12, the doors 16, 18, the shelves 20, 22, and the back panel 38. Although the shelves 20, 22 lend additional support and rigidity to the assembly 10 and provide convenient out-of-sight storage space in the open configuration, the shelves 20, 22 are an optional feature of the assembly 10 of this invention. Wheels 54 are attached to the base 34, so that when the table assembly 10 is in the open configuration, the feet 59 support the assembly 10 with the wheels 54 not touching the floor or support surface. Thus, the wheels 54 are positioned to move the table assembly 10 when in the closed configuration only. If it is also necessary to move the table assembly 10 when in the open configuration, the feet 59 may be replaced by wheels 54. If wheels 54 are used in place of the feet 59, the wheels 54 are all of the same height and may have a locking mechanism that can be set to prevent the assembly 10 from moving in either its open or closed configurations.

As seen with reference to FIGS. 3B, 4B, and 5–7 and 9–13, the lower edge of the front panel 14 has a convex curved base 34. The front display panel 14 is typically constructed of a thin, planar, lightweight, relatively flexible, light-transmittable, heat-resistant synthetic sheet material, which has been imprinted to meet the needs of the presentation. The term "light-transmittable" refers to the ability to transmit at least a visually perceptible amount of light and includes the materials that are transparent and translucent. The front display panel 14 is slidingly inserted into a convex curved groove which generally follows the profile curve of the base 34 and supports the panel 14 in the curved configuration. The display panel 14 may remain in position during conversion of the table assembly 10 from the closed to the open configurations, and can be easily removed for insertion of an alternate panel 14 with a different display.

Figure 4B:
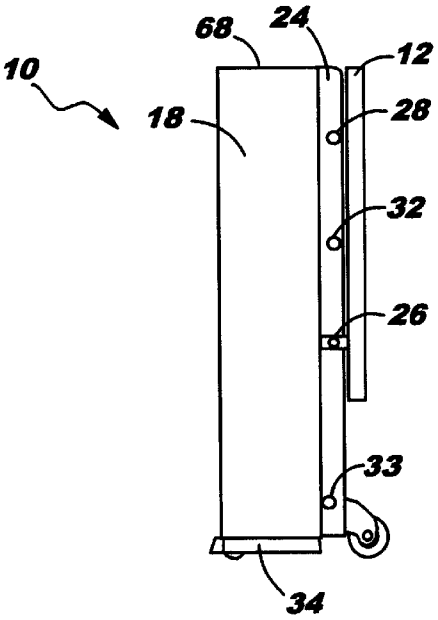
FIG. 4B shows a left end view.
Figure 4A:
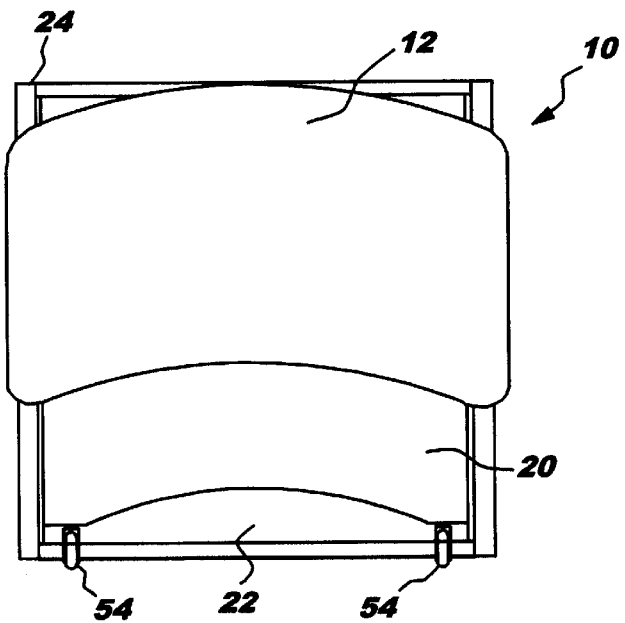
FIG. 4A shows a rear view.

FIGS. 4A and 4B show the back and left side, respectively, of the assembly 10 in the closed configuration. FIG. 4A shows the tabletop 12 in a vertical position and locked into the bracket 26. The doors 16, 18 are shown in the closed configuration overlying the front panel 14. The pin 28 is a pivot point for the hinge mechanism 30 connecting the tabletop 12 to the central frame member 24. The pin 32 is a pivot point connecting the center shelf 20 to the central frame member 24. The pin 33 is a pivot point connecting the lower shelf 22 to the central frame member 24.

Figure 8:
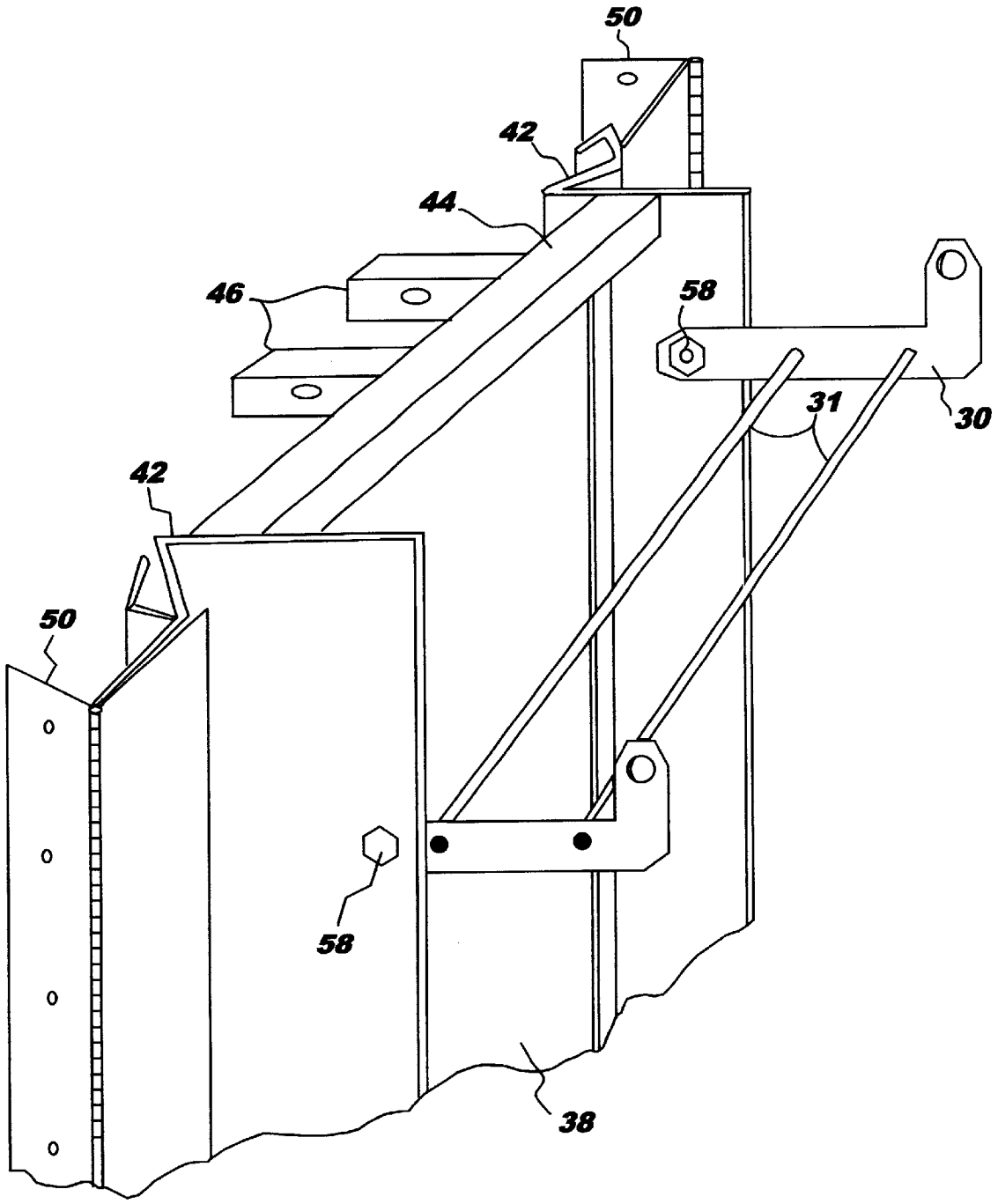
FIG. 8 is a partial perspective view of the frame of the table assembly of this invention showing the continuous hinges for connecting the doors and the hinge mechanism for connecting the tabletop.

As illustrated in FIGS. 5–8, attached to the upper backside of the two vertical corner extrusions 42 is a hinge 30 mechanism, attached to each corner extrusion 42 by a hinge pin 58. FIG. 8 is a partial perspective view of the supporting framework 24 of the table assembly 10, showing the continuous hinges 50 for connecting the doors 16, 18 to the corner extrusion 42 and the hinge mechanism 30 for connecting the tabletop 12 by means of hinge pin 58 and transverse supporting rods 31. The hinge 30 allows for about 90° of motion by the tabletop 12. When the table assembly 10 is converted to the closed position, the hinge 30 allows the tabletop 12 to pivot down over the two vertical corner extrusions 42 while at the same time moving down far enough to allow the tabletop 12 to position below the top of the two vertical corner extrusions 42. In the closed configuration of the table assembly 10, the tabletop 12 locks to a bracket 26 attached to each corner extrusion 42. The tabletop 12 may be hollow plastic and may be constructed as two interfitting plastic pieces 60 with internal reinforcements (not shown).

Figure 18:
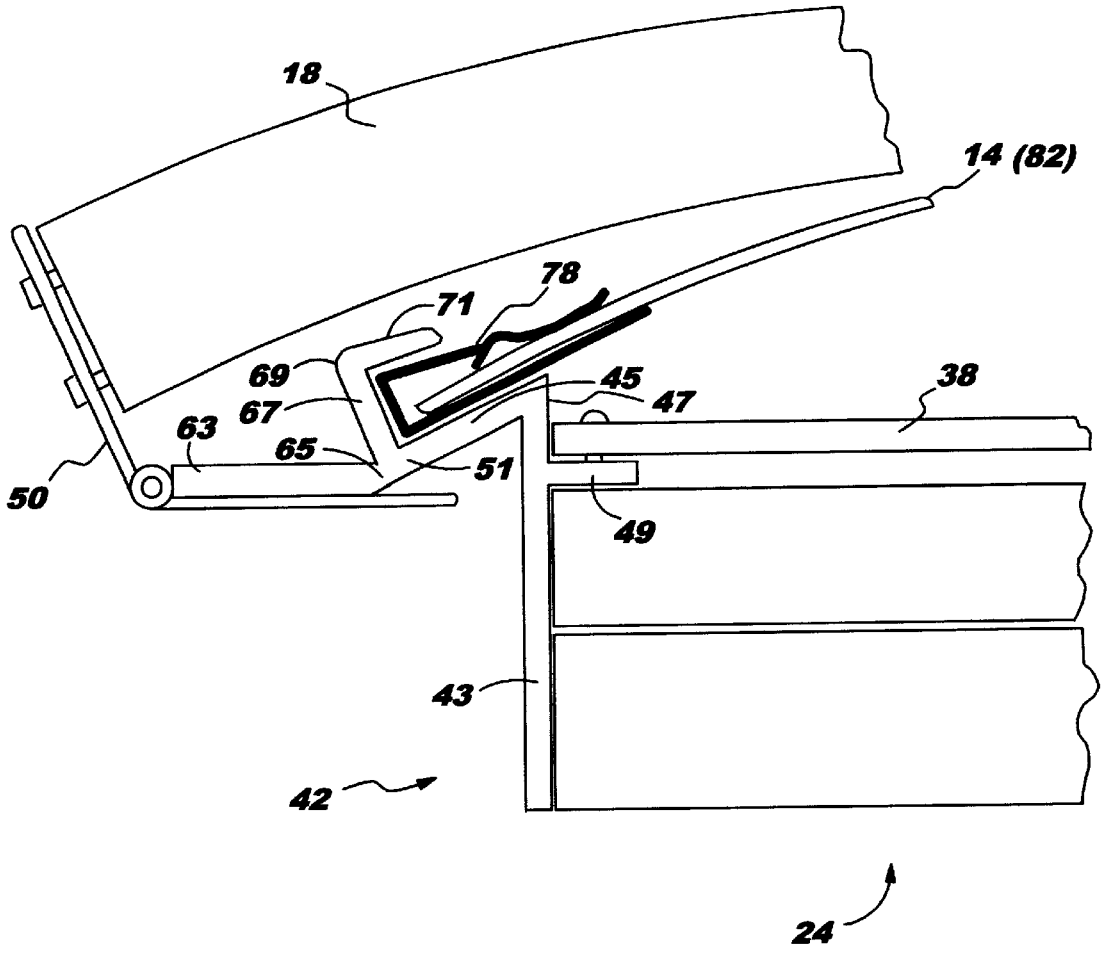
FIG. 18 is a partial profile view of the table assembly, showing the continuous hinge for connecting the door, a corner extrusion between the frame and the door, and the graphic clip for attaching the display panel over the lighting arrangement.

The central frame member 24, as seen in FIGS. 8 and 18, is constructed as follows. Two vertical corner extrusions 42, custom made for the inventive table assembly 10, are connected at top and bottom, respectively, by two square shaped tubes 44 to form a rectangle. Extending horizontally from the two square tubes 44 are shorter square tubes 46 as structural support members for the tabletop 12, when in the open configuration. Mounted to the outer flange 48 of each of the two vertical extrusions 42 is a continuous hinge 50. Each of the two doors 16, 18 fasten to one of the hinges 50. The doors 16, 18 may be hollow plastic and may be constructed as two interfitting plastic pieces with internal reinforcements. Each hinge 50 allows each door 16, 18 to pivot about 270° around the outer flange 48 of the corner extrusion 42 to which it is connected.

Figure 4C:
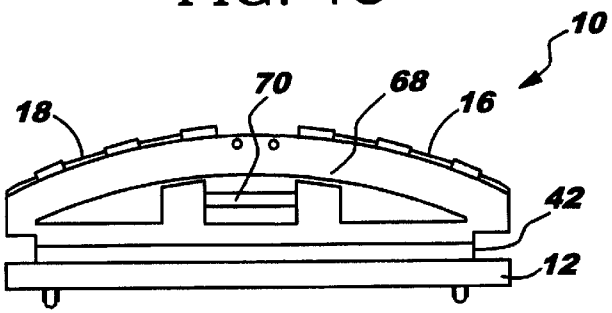
FIG. 4C shows a top view of the table assembly of this invention in the closed configuration.
Figure 5:
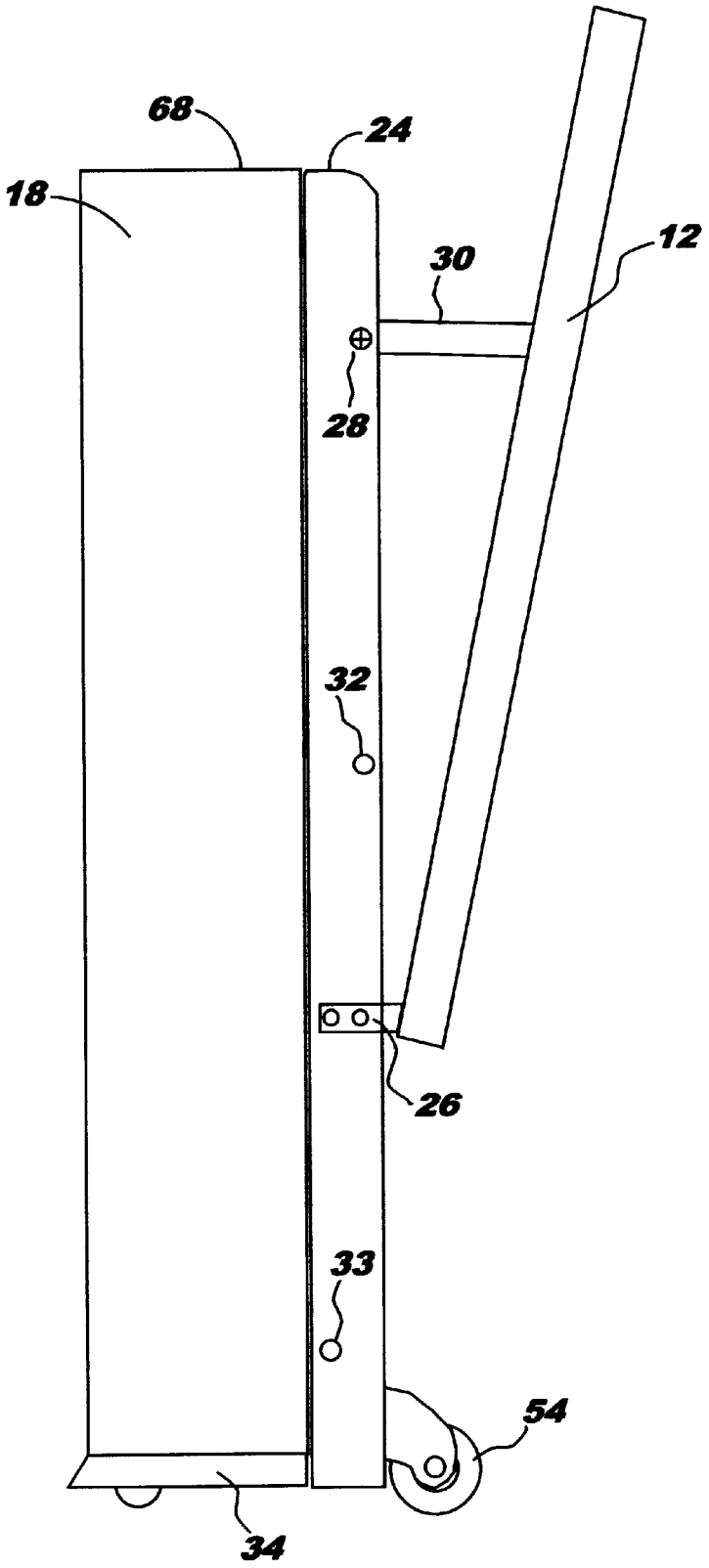
FIG. 5 is a plan view of the left side of the table assembly of this invention with the tabletop starting to deploy from the closed to the open configuration.
Figure 6:
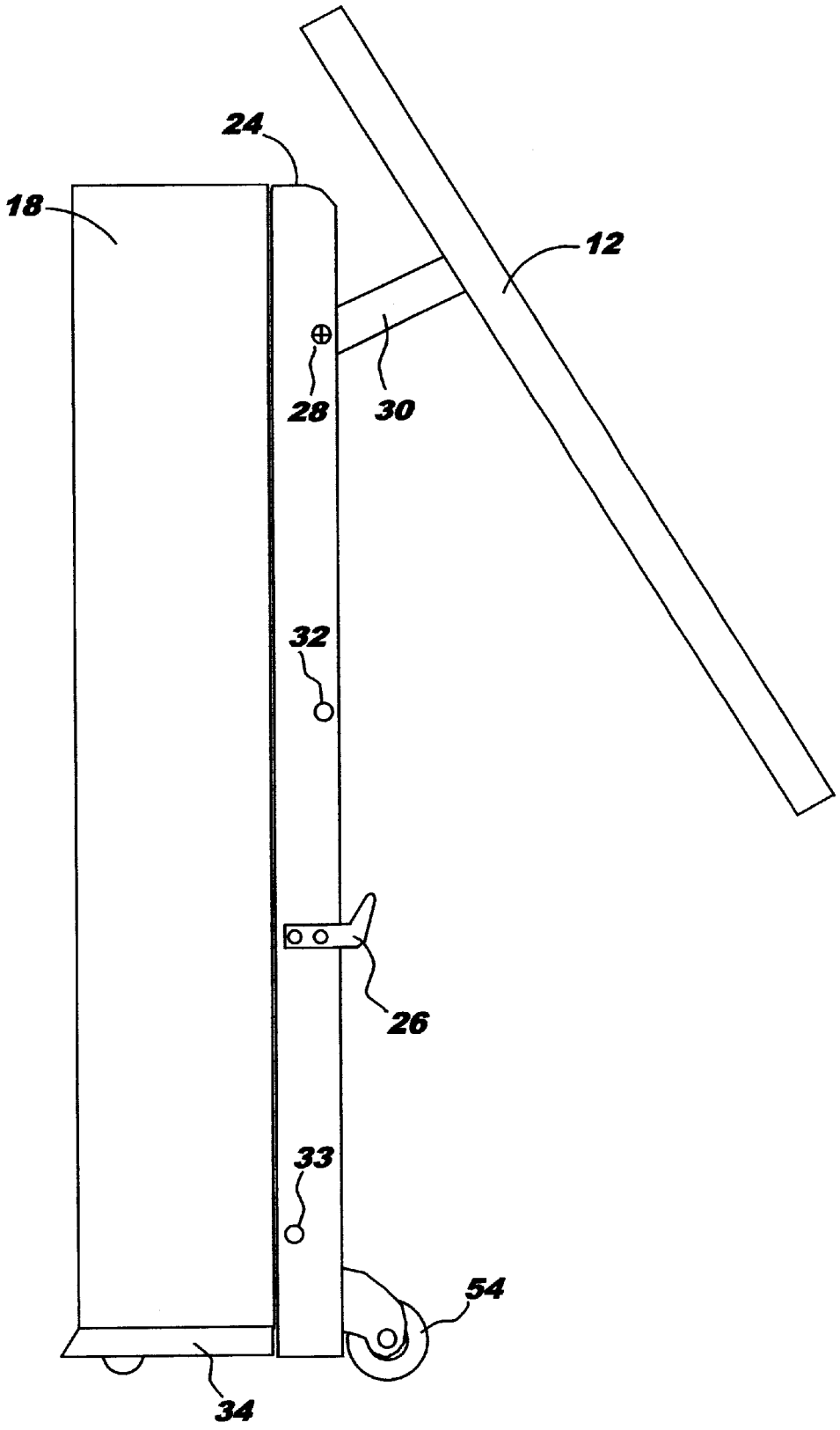
FIG. 6 is a plan view of the left side of the table assembly of this invention with the tabletop half-open.
Figure 7:
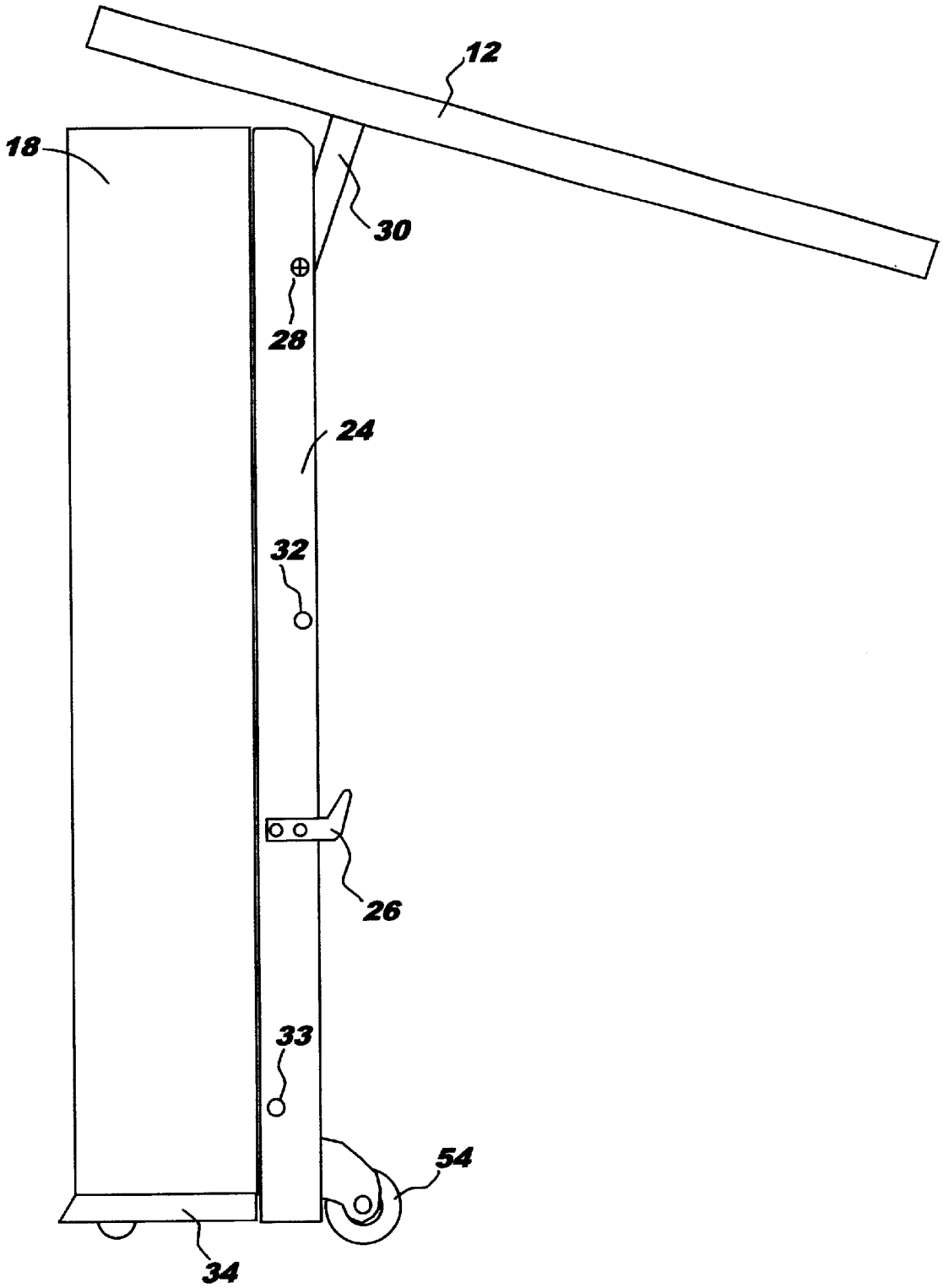
FIG. 7 is a plan view of the left side of the table assembly of this invention with the tabletop three-quarters open.
Figure 16:
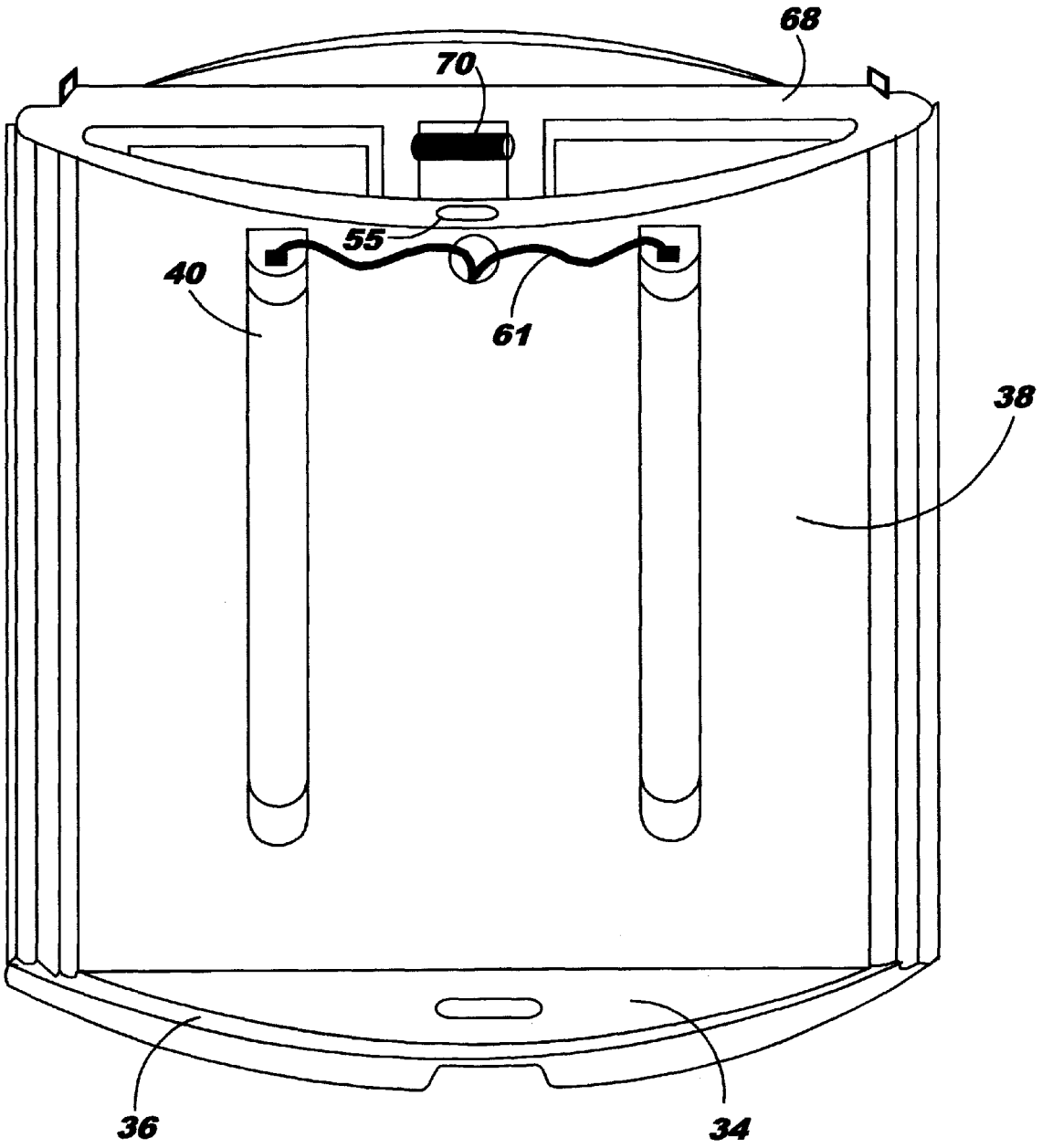
FIG. 16 shows a front plan view of the front panel of the table assembly of this invention with a display panel removed, showing the lighting arrangement.

The base 34, as seen in FIGS. 1, 2, 4B, 5–7, 9–14 and 16, is attached to the bottom of the frame 24 created by the two vertical corner extrusions 42 and two square horizontal cross members 44. The base 34 as shown provides a horizontal curved profile to the bottom of the table assembly 10. As seen, for example, in FIGS. 4C and 16, attached to the top of the two vertical corner extrusions 42 and the horizontal square cross tubing 44 is a cornice 68 that, along with the base 34, urges the front panel 14 into a graceful convex curvature. The base 34 and the cornice 68 serve as the bottom and top, respectively, of the light box, which is comprised of the back panel 38 supporting the fluorescent tubes 40 and the front panel 14 supporting a graphic 82. The cornice 68 has a recess for a handle 70, as seen in FIGS. 4C and 16, for conveniently moving the table assembly 10 when in its closed configuration. Although the Figures herein illustrate the front panel 14 as forming a convex profile curvature and the doors 16, 18 as each forming a corresponding concave profile curvature, the front panel 14 and the doors 16, 18 may also each be planer or of any other convenient mating attractive profiles.

As seen in FIGS. 8, 16 and 18, attached to flanges 48 on the vertical corner extrusions 42 is a back panel 38. FIG. 16 shows the central frame member 24 of the table assembly 10 with the front panel 14 removed, showing the lighting arrangement, the back panel 38 with the light fixtures 40. A convenient lighting arrangement, as illustrated, employs a pair of vertically parallel fluorescent tubes 40 supported on a generally planar vertical back panel 38. Other sources of illumination that will provide sufficient backlighting without development of excess heat may also be used. A hole 56 in the back panel 38 allows access for a cord 61 from the light fixtures 40 to a power source. For use in a location remote from a source of electrical current, the lighting arrangement may be powered by an alternative source, such as a portable generator or battery power.

Figure 20A:
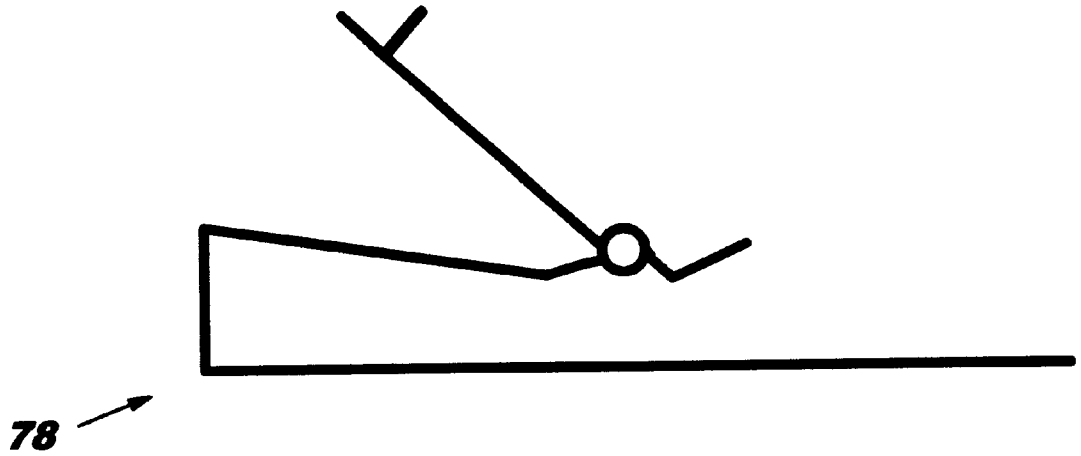
FIGS. 20A, 20B illustrate the graphic clip opened, to receive a graphic, and closed, to retain a graphic, respectively.
Figure 20B:
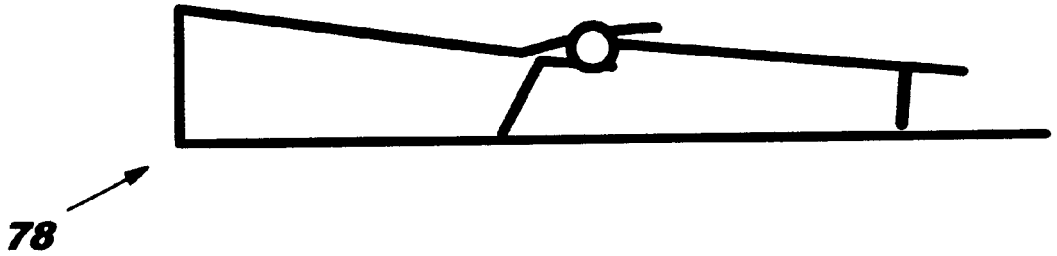

FIG. 18 is a partial profile view of the table assembly 10, showing the continuous hinge 50 for connecting the door 16 or 18, the vertical corner extrusion 42 between the frame 24 and the door 16 or 18, and the clip 78 for attaching the display panel over the lighting arrangement. The corner extrusion 42 is made especially for the table assembly 10 of this invention. The corner member 42 has a straight length with a uniform cross-section. First and second flanges 43, 45 of the cross-section meet at a first apex 47 in a first angle of about 65°. Extending perpendicularly from the first flange 43 is a third flange 49 exterior to the first angle and spaced from the first apex 47. The second flange 45 has a first bend between first and second segments 51, 63, the first segment 51 extends from the first apex 47 of the first angle. The first bend forms a second apex 65 of a second angle of about 150° exterior to the first angle, with the second apex 65 spaced from the first apex 47. A fourth flange 67 extends from the second apex 65 exterior to the first angle. The fourth flange 67 is essentially perpendicular to the first segment 51 of the second flange 45. The fourth flange 67 has a second bend between third and fourth segments 69, 71. The third segment 69 extends from the second apex 65 of the second angle. The fourth segment 71 extends back toward the first apex 47 forming a third angle of about 85° with the third segment 69. The plastic graphic clip 78, perhaps best seen in the profile of FIG. 20A, press-fits into a pocket between the third and fourth segments and the first segment 51 formed in each of the vertical corner extrusions 42, and allows quick attachment of the front panel 14 to the central frame member 24 of the table assembly 10. A suitable plastic graphic clip 78 is available from Versamount USA, Fond du Lac, Wis. 54937, under the name Snappex. The front panel 14 is thin, flexible and resilient, so that it forms into a curve around the base 34 and cornice 68 of the lightbox 90 of the table assembly 10. The graphic clip 78 may also retain a graphic 82 on the front panel 14.

Figure 19:
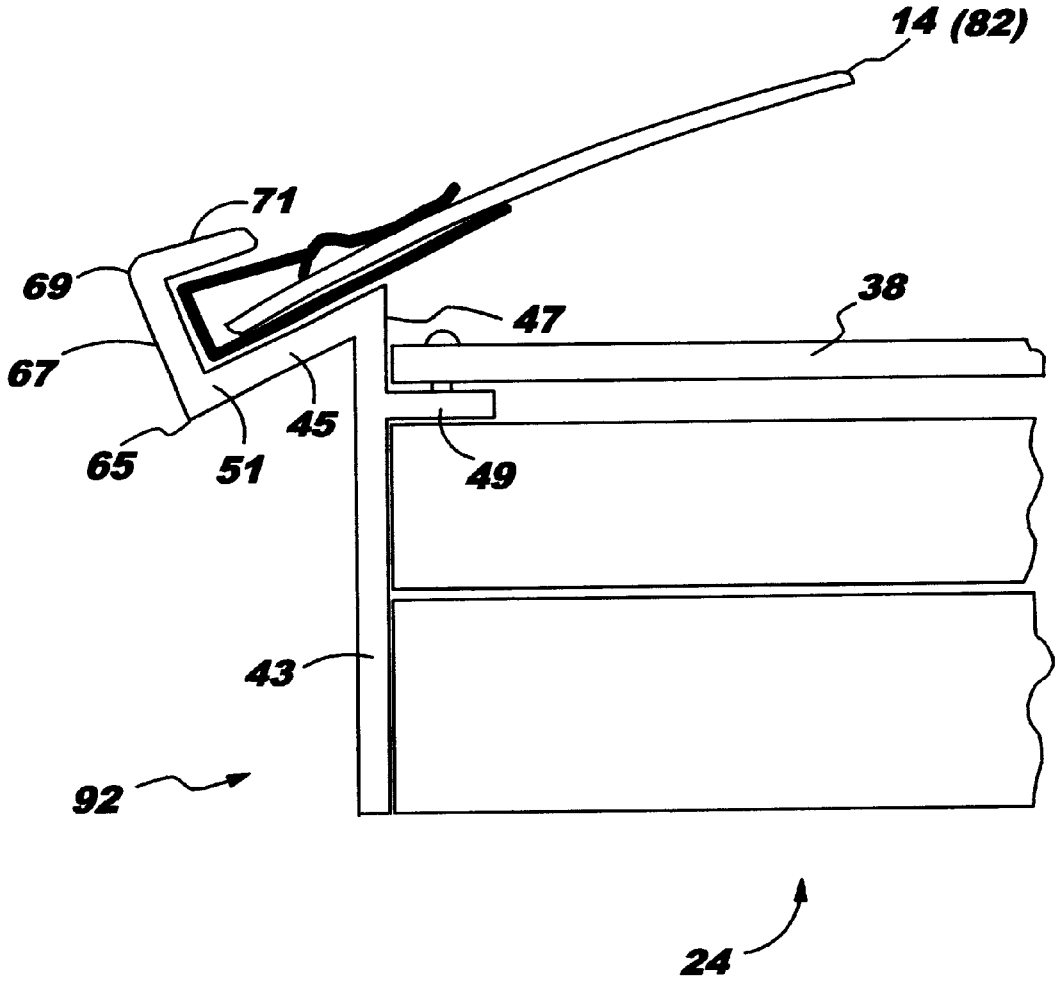
FIG. 19 is a partial profile view of the lightbox, showing a corner extrusion attached to the frame, and the graphic clip for attaching the display panel over the lighting arrangement.

FIG. 19 is a partial profile view of the lightbox 90, showing a corner extrusion 92 attached to the frame 24, and the graphic clip 78 for attaching the front display panel 14 over the lighting arrangement on the back panel 38. The corner extrusion 92 is made especially for the light box 90 of this invention. The corner member 92 has a straight length with a uniform cross-section. First and second flanges 43, 45 of the cross-section meet at a first apex 47 in a first angle of about 65°. Extending perpendicularly from the first flange 43 is a third flange 49 exterior to the first angle and spaced from the first apex 47. The second flange 45 has a right-angle bend extending exterior to the first angle and spaced from the first apex 47. The second flange 45 then extends back toward the first apex 47 in an angle bend of about 85°. The plastic graphic clip 78, seen in the profile of FIG. 20A, press-fits between the right-angle bend and the approximately 85° angle bend, and allows quick attachment of the front panel 14 to the central frame member 24 of the table assembly 10. The lighting arrangement is as described above with reference to FIG. 16.

The front display panel 14 is typically constructed of a thin, planar, lightweight, relatively flexible, light-transmittable, heat-resistant synthetic sheet material, which has been imprinted to meet the needs of the presentation. The term "light-transmittable" refers to the ability to transmit at least a visually perceptible amount of light and includes the materials that are transparent and translucent. The front display panel 14, supporting a graphic 82, is inserted into convex curved grooves which generally follows the profile curve of the base 34 and the cornice 68 and support the panel 14 in the curved configuration. The graphic 82 is typically constructed of material that meets the requirements for the panel 14, but is of even thinner and more flexible material. The display panel 14 and graphic 82 may remain in position during conversion of the table assembly 10 between the closed and the open configurations, and can be easily removed for insertion of an alternate panel 14 with a different graphic 82.

The lights 40, when turned on, provide back lighting to the front panel 14 and the attached graphic 82. In lieu of having a separate front panel 14 and graphic 82, the front panel 14 may be directly imprinted with the desired design. When the backlighting feature is not used, the transparent or translucent display panel 14 may be replaced with a panel 14 that is opaque or relatively opaque. The lights 40 for back lighting the display panel 14, and accessory devices requiring electrical power, plug into an electrical strip (not shown)

attached to the back of the front panel 14. The electrical strip in turn plugs into any convenient source of electric current, such as an electrical outlet, a portable generator or a battery power. The electrical strip provides a convenient source of electric current for electrical accessories, such as an electric oven or other electric cooking device for supermarket aisle advertising.

Figure 9:
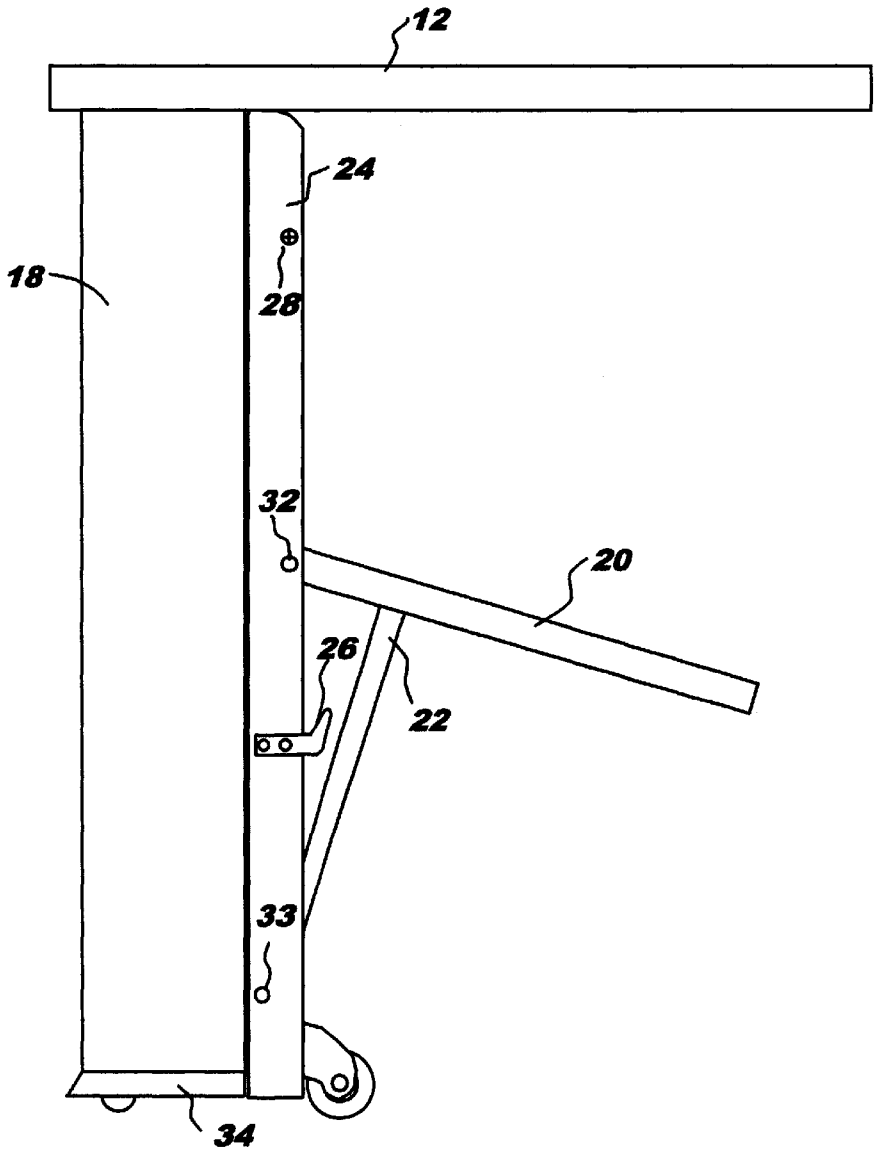
FIG. 9 is a plan view of the left side of the table assembly of this invention with the tabletop fully open and the two shelves starting to deploy to the open configuration.
Figure 10:
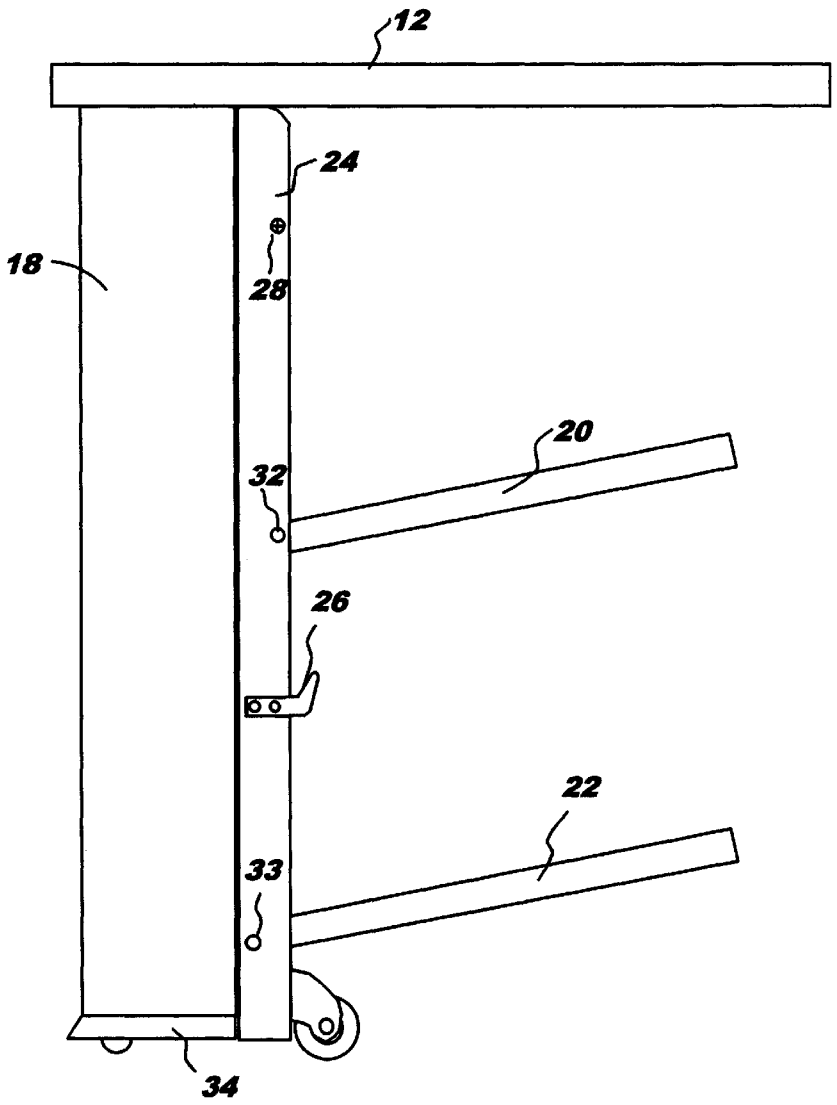
FIG. 10 is a plan view of the left side of the table assembly of this invention with the tabletop horizontal and the two shelves angled upward prior to engaging the doors.
Figure 11:
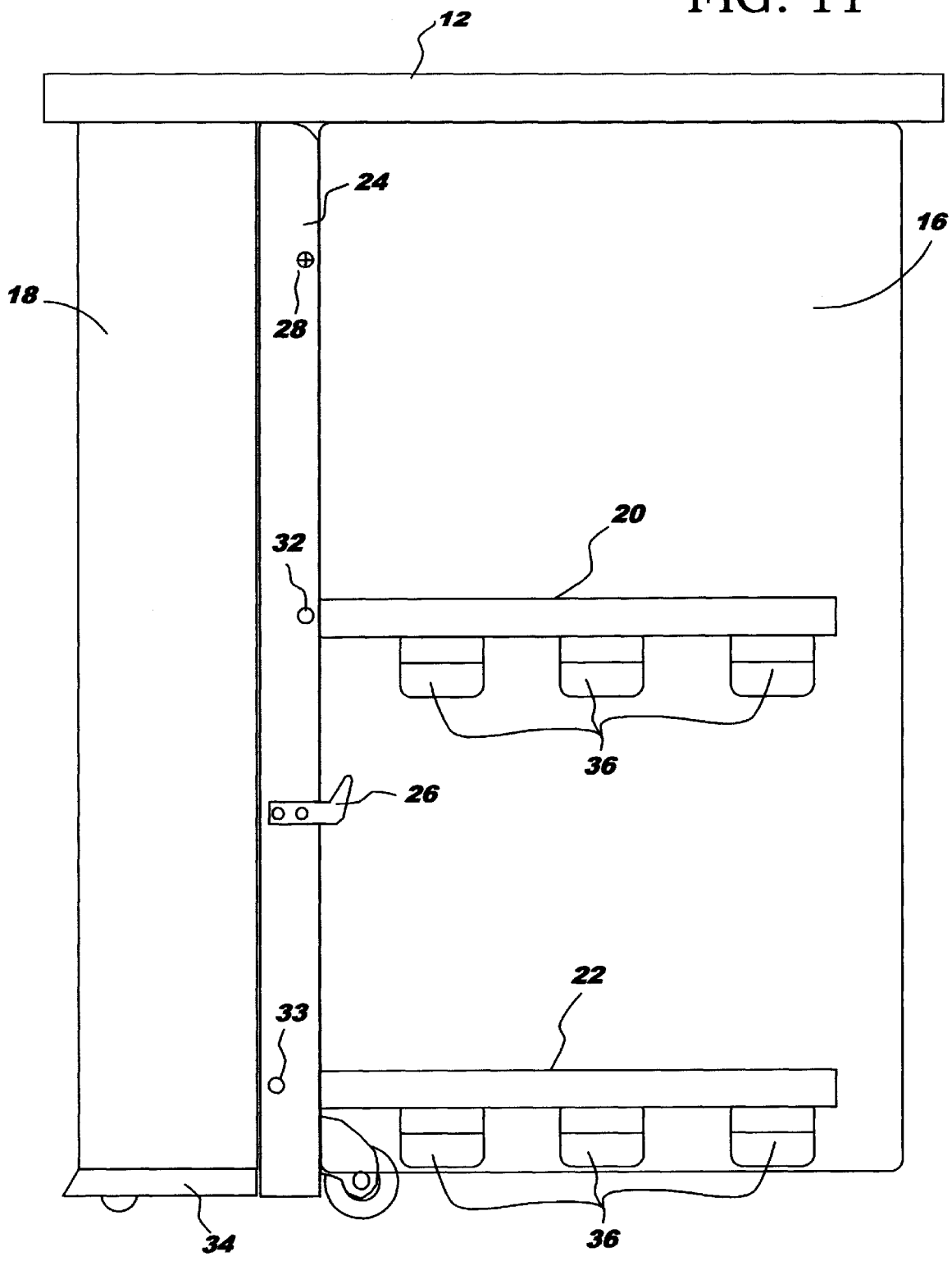
FIG. 11 is a plan view of the left side of the table assembly of this invention with the tabletop horizontal and the two shelves engaged by ledges on the right door.

As seen with reference to FIGS. 9–11, attached to the lower backside of the vertical corner extrusion 42 is a bottom shelf 22 that hinges upward. When the table assembly 10 is in the closed configuration, the bottom shelf 22 may be held flat against the back panel 38 by any suitable easily releasable means, such as Velcro. The second shelf 20 is located at approximately the midpoint of the height of the vertical corner extrusion 42. This second shelf 20 folds downward over the bottom shelf 22 when the bottom shelf 22 is in the upward position. Each shelf 20, 22 is connected at two points on the two vertical corner extrusions 42 by a hinge pin 28 that allows for 90° of pivot. The shelves 20, 22 may be molded with recesses, cavities and other features for storage of various items as required for the particular presentation. For example, for supermarket "aisle advertising," cushioning pads (not shown) may be attached to the underside of either shelf 20, 22, as by Velcro or any similar suitable means. The cushioning pads may be detached and placed on the floor at the rear of the table assembly 10 to relieve foot pressure for the presenter from long periods of standing, FIG. 9 is a plan view of the left side of the table assembly 10 with the tabletop 12 fully open and the two shelves 20, 22 starting to deploy from the closed to the open configuration. FIG. 10 is a plan view of the left side of the table assembly 10 with the tabletop 12 horizontal and the two shelves 20, 22 angled upward prior to engaging ledges 36 on the doors 16, 18. FIG. 11 is a plan view of the left side of the table assembly 10 with the tabletop 12 horizontal and the two shelves 20, 22 horizontally engaged by ledges 36 on the right door 16. The tabletop 12 is horizontal in the open configuration of the table assembly 10. If desired, a separate podium, lectern or pulpit (not shown) with a surface angled backward from the front of the table assembly 10 may be attached to the tabletop 12. The tabletop 12 may be formed with recesses or features (not shown) to retain a slant-top podium, lectern or pulpit in position for use.

Figure 12:
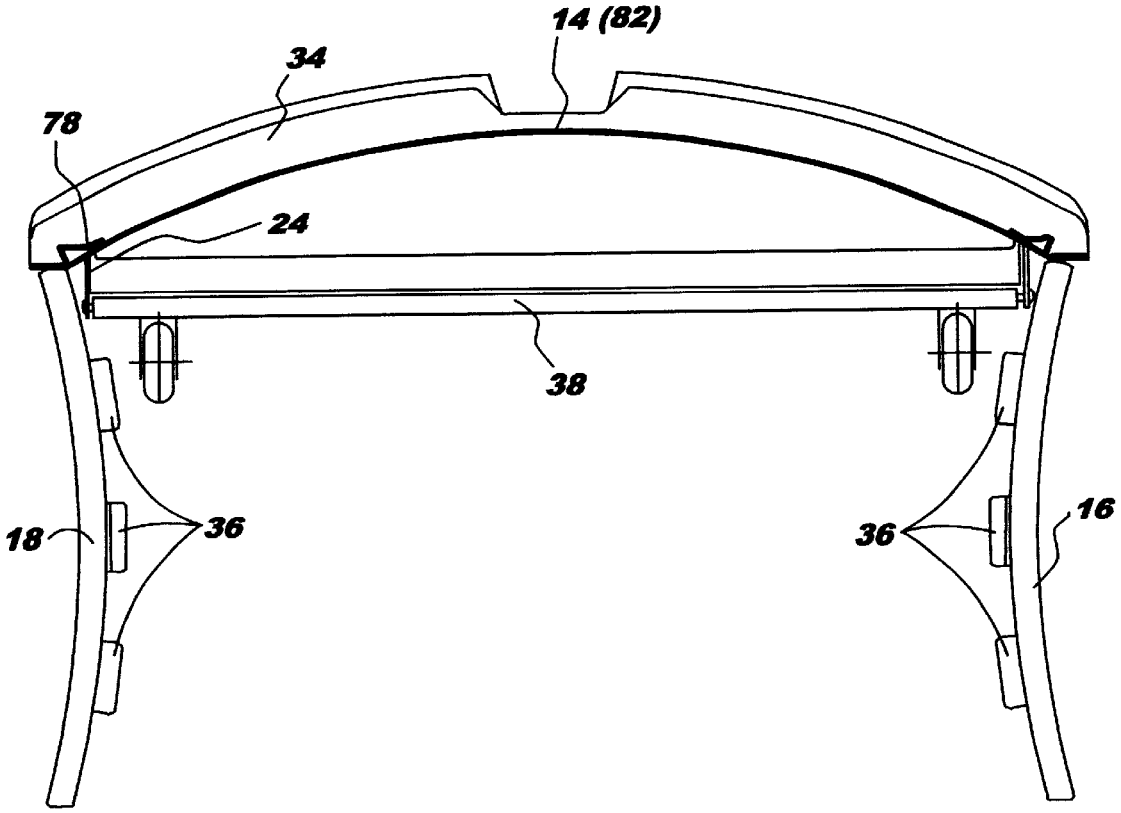
FIG. 12 is a bottom plan view of the table assembly of this invention with the doors in the open configuration.
Figure 13:
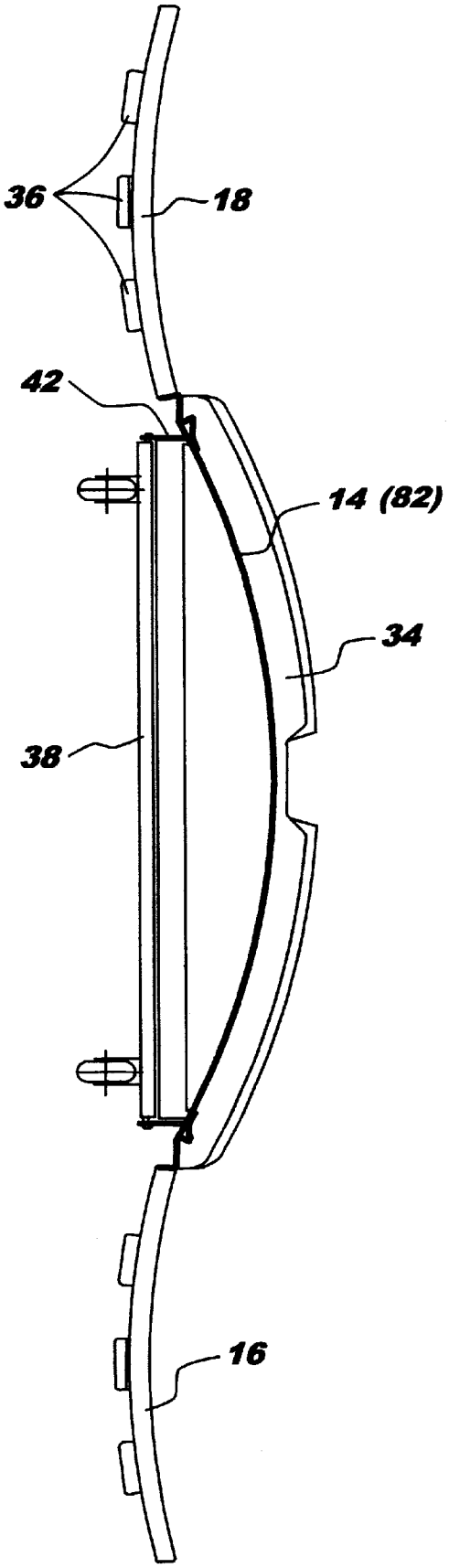
FIG. 13 is a profile plan view of the table assembly of this invention with the tabletop vertical and the doors in the half-open configuration.

FIG. 12 is a bottom plan view of the table assembly 10 with the doors 16, 18 in the open configuration. FIG. 13 is a plan view of the top of the table assembly 10 with the tabletop 12 vertical and the doors 16, 18 in the half-open configuration. In this half-open configuration, the table assembly 10 provides a space-economical display, with the doors 16, 18 extending laterally from the front panel 14, with the front panel 14 and the doors 16, 18 each optionally containing back-lit displays, and all visible from one angle. Thus, even when the tabletop 12 is not in use, the table assembly 10 still provides an attractive and useful display of the products, services or information being presented. This is an extremely economical alternative to simply storing the table assembly 10 out of sight when the tabletop 12 is not needed. With its compact front-to-back profile in this half-open configuration, the table assembly 10 displays conveniently against a wall or other vertical backdrop. Due to the 270° of pivot between the doors 16, 18 and the front panel 14, the angles may be widely and independent varied to suit the needs of the display environment.

Figure 14:
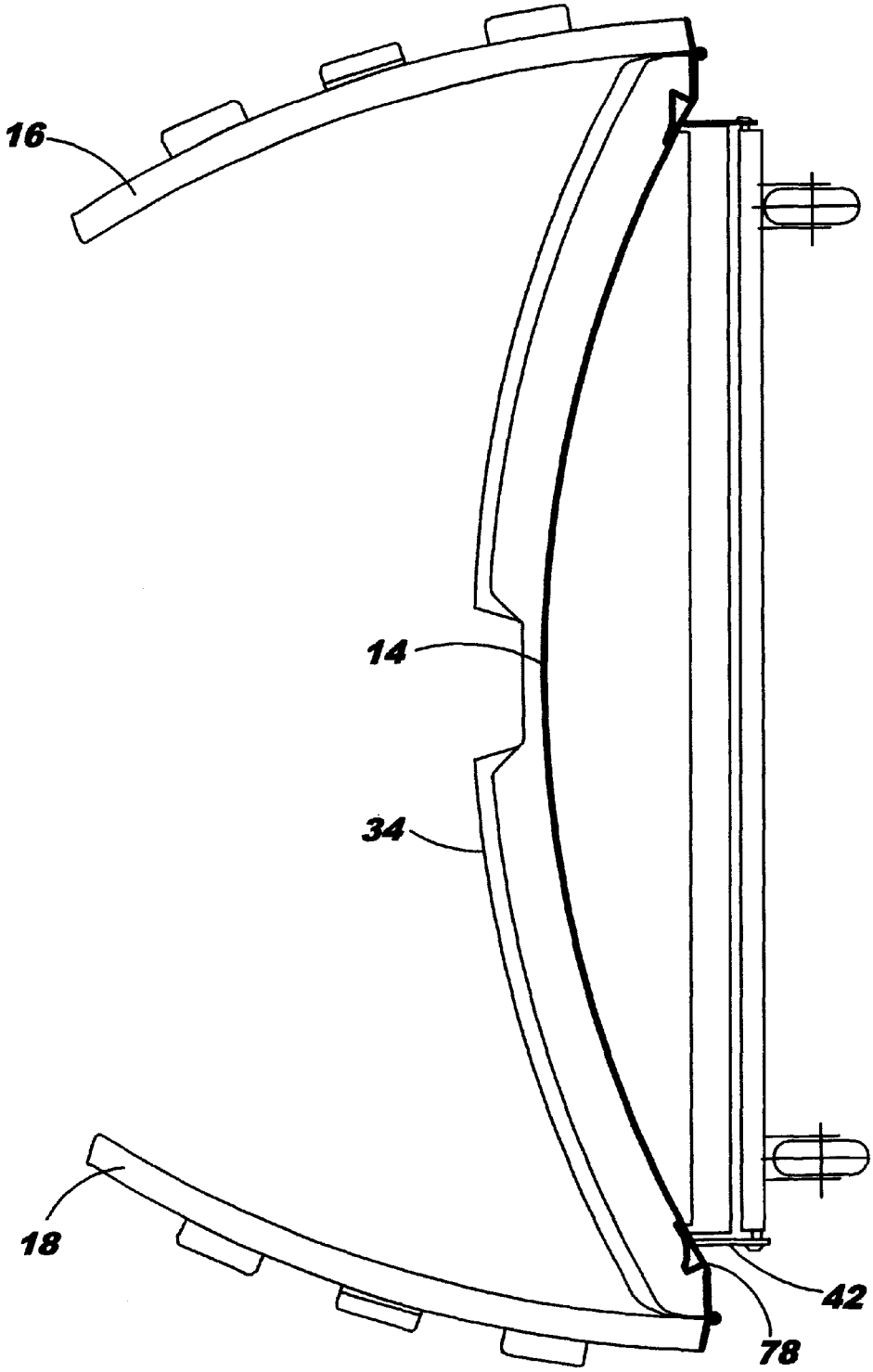
FIG. 14 is a plan view of the top of the table assembly of this invention with the tabletop vertical and the doors in the three-quarter closed configuration.
Figure 15:
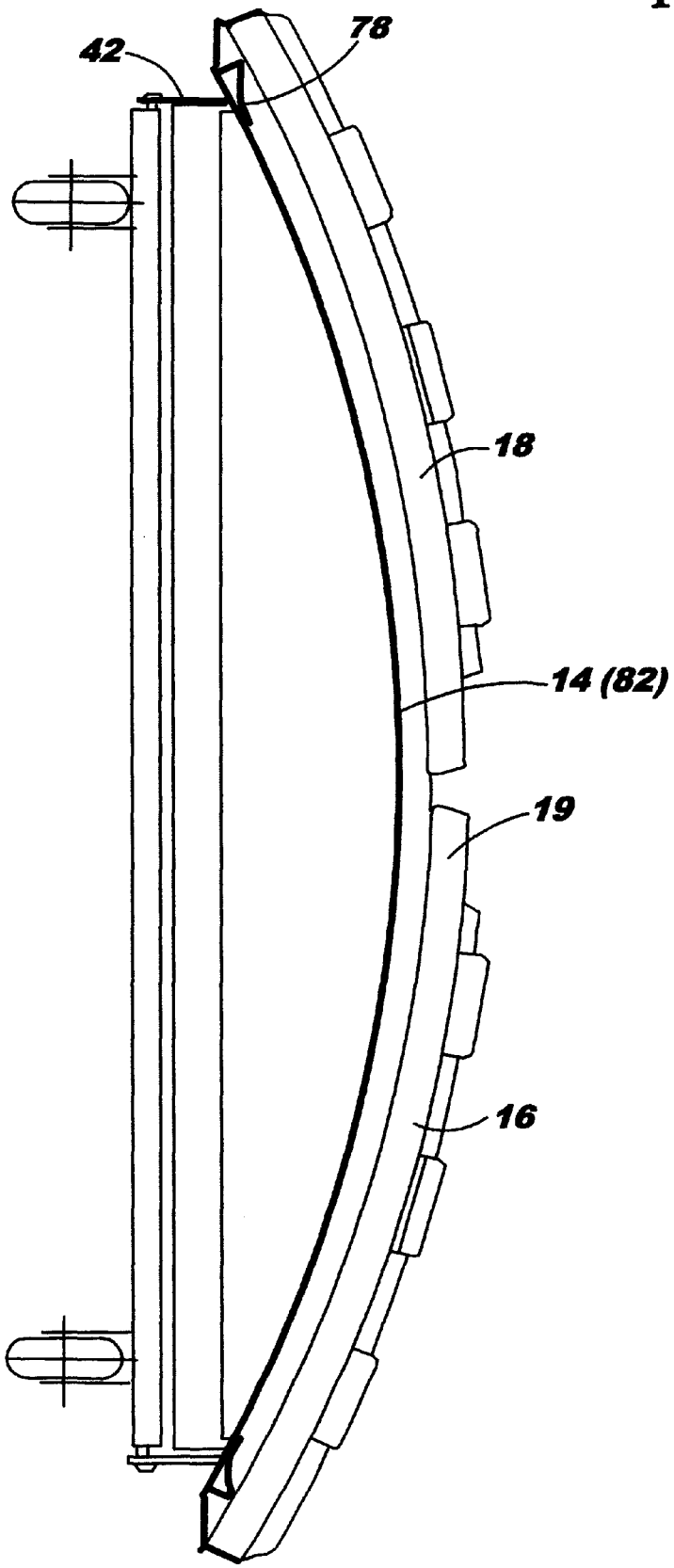
FIG. 15 is a plan view of the top of the table assembly of this invention with the tabletop vertical and the doors in the fully closed configuration.

FIG. 14 is a plan view of the top of the table assembly 10 with the tabletop 12 vertical and the doors 16, 18 in a three-quarter closed configuration. FIG. 15 is a plan view of the top of the table assembly 10 with the tabletop 12 vertical and the doors 16, 18 in the fully closed configuration.

Figure 17A:
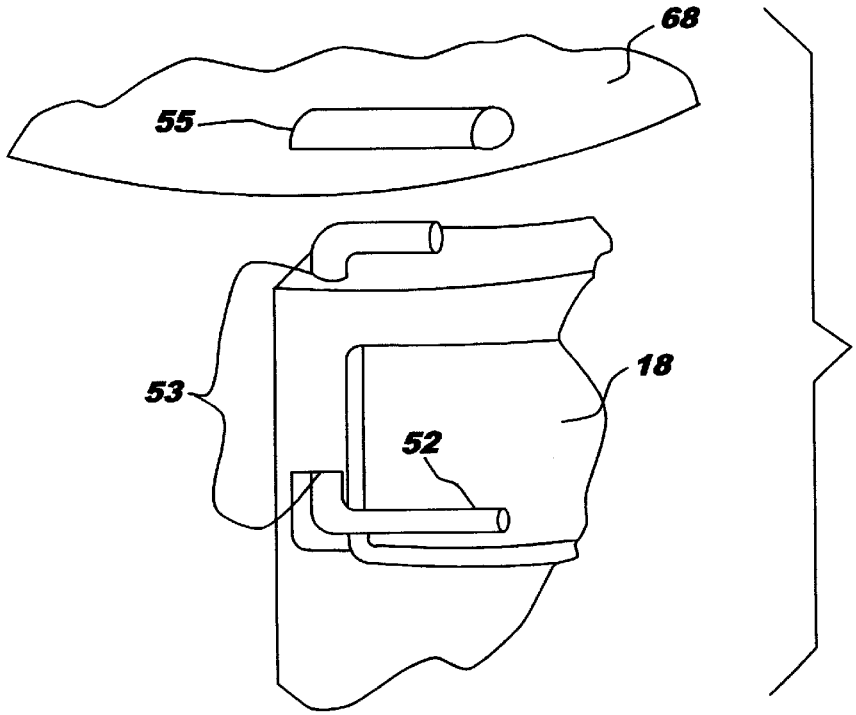
FIG. 17A shows the latch mechanism for locking the table assembly in the closed configuration.
Figure 17B:
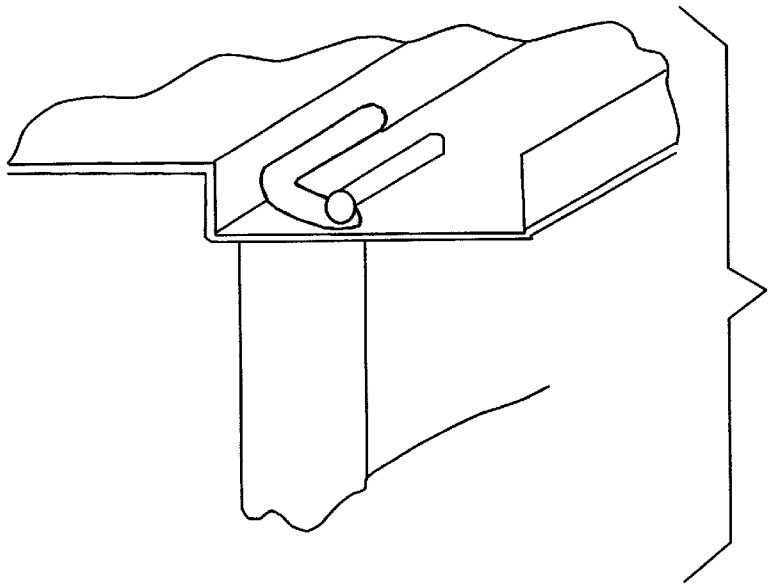
FIG. 17B shows the latch mechanism 52 for locking the doors and 16, 18 to tabletop 12 in open position.

FIG. 17A shows the latch mechanism 52 for locking the doors 16, 18 of the table assembly 10 to the cornice 68 in the closed configuration, and 17B shows the latch mechanism 52 for locking the doors 16, 18 to tabletop 12 in the open position. As seen in FIG. 17A, a generally C-shaped upper latching member 52, suitably of aluminum or other metal, pivotally threads through a pair of apertures 53 formed in the upper corner of each door 16 or 18. The apertures 53 are formed on the door surface that faces the shelves 20, 22 when the table assembly 10 is in the open configuration. When the table assembly 10 is in the closed configuration, each latching member 52, positioned parallel to the door 16 or 18 surface, snap-fits into a recess 55 in the cornice 68. When the table assembly 10 is in the open configuration, each latching member 52, positioned essentially perpendicular to the door 16 or 18 surface, supports and latches to the horizontal tabletop 12.

Although certain components of the table assembly 10 have been described as constructed of plastic, aluminum, or some other specific material, the table assembly 10 is constructable of any suitable lightweight, low-cost, durable, attractive materials, such as wood, metal (e.g., steel, aluminum), plastics, composites and combinations thereof.

The sequence to convert the table assembly 10 from the closed configuration to the open configuration is as follows. The table assembly 10 is illustrated in the closed configuration in FIGS. 4A, 4B and 4C. Unlatch and swing open the two doors 16 each about 180° around the continuous hinge 50 in opposite clockwise/counter-clockwise directions. Note that in this partially open configuration, as illustrated with reference to FIG. 11, the table assembly 10 may be used as a display without the availability of tabletop 12 or shelf 20, 22 space. Thus, the table assembly 10 of this invention serves a purpose of advertising or presentation of information, even when tabletop 12 or shelf 20, 22 space are not available, thus using the display features in a compact space even when the table assembly 10 is unattended. Pivot the tabletop 12 upward from a vertical position behind the central frame member 24 to a horizontal position over the top of the central frame member 24. Swing a first door 16 or 18 about 90° (continuing in the same clockwise/counter-clockwise direction) and position the door 16 or 18 under the tabletop 12. Note that either door may be designated the "first" or the "second" door in converting the table assembly 10 between the closed and the open configurations. Pivot the center shelf 20 upward and allow the bottom shelf 22 to pivot downward. Move the first door 16 or 18 toward the shelves 20, 22 and lock the two shelves 20, 22 to the slots 88 on the inside of the first door 16 or 18. Move the second door 16 or 18 around (in a clock direction opposite to that of the first door 16 or 18) and lock the two shelves 20, 22 into the slots 88 on the inside of the second door 16 or 18. Connect the table assembly 10 to a suitable source of electrical current. Turn on the light switch.

The sequence to convert the table assembly 10 from the open configuration to the closed configuration generally reverses the steps described in the previous paragraph. Disconnect the table assembly 10 from the electrical current source. Unlock the two shelves 20, 22 from the slots 88 on the inside of the first door 16 or 18. Again, note that either door may be designated the "first" or the "second" door in converting the table assembly 10 between the open and the closed configurations. Swing the first door 16 or 18 about 90°. Unlock the two shelves 20, 22 from the slots 88 on the inside of the second door 16 or 18. Swing the second door 16 or 18 about 90° (in a clock direction opposite to that of the first door 16 or 18). Pivot the bottom shelf 22 upward and pivot the center shelf 20 downward and partially overlapping the bottom shelf 22. Note that this is the partially open configuration described in the previous paragraph and illustrated with reference to FIG. 11. Swing the first door 16 or 18 about 180° (continuing in the same clockwise/counter-clockwise direction) until the first door 16 or 18 overlaps the front panel 14. Swing the second door 16 or 18 about 180° (continuing in the same clockwise/counter-clockwise direction) until the second door 16 or 18 overlaps the first door 16 or 18 and the front panel 14. The doors 16, 18 lock in the closed configuration, as illustrated in FIG. 15. Pivot the tabletop 12 downward from a horizontal position over the top of the front panel 14 to a vertical position behind the front panel 14.

That which is claimed is:

1. A display assembly comprising:

a frame;

a pair of doors;

a panel, with means to backlight the panel; and a tabletop;

wherein the doors are individually hinged to the frame and pivotable through at least about 270 degrees.

2. The display assembly of claim 1, wherein the doors are positionable to be viewable together with the panel to provide a vertical display.

3. A table assembly convertible between closed and open configurations, the assembly comprising:

a frame, a panel, a pair of doors, a side edge of each door pivotally connected to each side edge of the frame, and a tabletop pivotally connected to the frame top edge such that, in the closed configuration, the tabletop overlies the panel back surface, and the doors overlie the panel front surface;

wherein the assembly converts from the closed to the open configuration by pivoting each door about 270° about each frame side edge, and pivoting the tabletop upward with the tabletop supported by the frame top edge and the door top edges.

4. The table assembly of claim 3, wherein, in the open configuration, the doors extend perpendicularly vertical from the frame side edges, and the tabletop is supported by the frame and door top edges.

5. The assembly according to claim 3, wherein the assembly converts from the open to the closed configurations by pivoting each door about 270° about each frame side edge, so that the doors overlie the panel front surface, and pivoting the tabletop downward to a vertical position to overlie the frame back surface.

6. The assembly according to claim 3, wherein the assembly is further convertible to a display configuration intermediate between the closed and open configurations, wherein the tabletop is pivoted downward to overlie the frame back surface, and the doors extend laterally from the frame side edges.

7. The assembly according to claim 6, wherein the assembly converts from the closed to the display configuration by pivoting each door about 180° about each frame side edge, respectively.

8. The assembly according to claim 7, wherein the assembly converts from the open to the display configuration by pivoting each door about 90° about each frame side edge, respectively, so that the doors extend laterally from the frame side edges, and pivoting the tabletop downward to a vertical position to overlie the frame back surface.

9. The assembly according to claim 3, wherein the frame further comprises illumination means, and the panel is light-transmittable.

10. The assembly according to claim 9, wherein the light-transmittable panel supports a graphic.

11. The assembly according to claim 10, wherein the illumination means is fluorescent.

12. The assembly according to claim 3, wherein the panel has a generally convex profile and each door has a generally concave profile.

13. A table assembly convertible between closed and open configurations the assembly comprising:

a frame;

a panel;

a corner member for retaining the panel to the frame;

a pair of doors, each door pivotally connected to a side edge of a frame by means of the corner member, allowing about 270° of rotation, a tabletop pivotally connected to the frame allowing 90° of rotation, and upper and lower shelves pivotally connected to the frame back surface each allowing about 90° of rotation.

14. A table assembly according to claim 13, wherein, in the closed configuration, the shelves each pivot to overlie the frame back surface, the tabletop pivots to overlie the shelves, and the doors pivot to overlie the panel front surface.

15. A table assembly according to claim 13, wherein in the open configuration, the doors extend perpendicularly vertical from the frame side edges, the shelves extend perpendicularly horizontal from the frame back surface supported by the doors, and the tabletop is supported by the frame and door top edges.

16. A corner member having length with a uniform cross-section, comprising:

first and second flanges meeting at a first apex in a first angle of about 65°;

the first flange having a third flange extending perpendicularly exterior to the first angle and spaced from the first apex;

the second flange having a first bend between first and second segments, the first segment extending from the first apex in the first angle, the first bend forming a second apex of a second angle of about 150° exterior to the first angle, with the second apex spaced from the first apex; and a fourth flange extending from the second apex exterior to the first angle, the fourth flange essentially perpendicular to the first segment of the second flange, the fourth flange having a second bend between third and fourth segments, the third segment extending from the second apex in the second angle, the fourth segment extending back toward the first apex forming a third angle of about 85° with the third segment.

17. A corner member having length with a uniform cross-section, comprising:

first and second flanges meeting at a first apex in a first angle of about 65°;

the first flange having a third flange extending perpendicularly exterior to the first angle and spaced from the first apex;

the second flange having a right-angle bend extending exterior to the first angle and spaced from the first apex, the second flange then extending back toward the first apex in an angle bend of about 85°.

18. A lightbox comprising:

a pair of corner members according to claim 17, a back panel attached to the third flanges of the pair of corner members, the back panel supporting an illumination means;

a graphic clip retained by each corner member in a pocket of the second flange between the right-angle bend and the 85° angle bend; and a light-transmittable panel retained between the graphic clips.

* * * * *